US011441467B2

(12) United States Patent
Kinnaird et al.

(10) Patent No.: US 11,441,467 B2
(45) Date of Patent: Sep. 13, 2022

(54) INTEGRATED HELICAL HEATER AND TEMPERATURE SENSOR

(71) Applicant: Faurecia Emissions Control Technologies, USA, LLC, Columbus, IN (US)

(72) Inventors: Edward Kinnaird, Columbus, IN (US); John Rohde, Columbus, IN (US); Alfred Tucker, Columbus, IN (US)

(73) Assignee: Faurecia Emissions Control Technologies, USA, LLC, Columbus, IN (US)

( * ) Notice: Subject to any disclaimer, the term of this patent is extended or adjusted under 35 U.S.C. 154(b) by 0 days.

(21) Appl. No.: 17/124,586

(22) Filed: Dec. 17, 2020

(65) Prior Publication Data

US 2022/0195903 A1 Jun. 23, 2022

(51) Int. Cl.
*F01N 3/20* (2006.01)

(52) U.S. Cl.
CPC ..... *F01N 3/208* (2013.01); *F01N 3/2013* (2013.01); *F01N 2610/02* (2013.01); *F01N 2610/10* (2013.01)

(58) Field of Classification Search
CPC ..... F01N 3/00; F01N 3/2013; F01N 2610/02; F01N 2610/10; F01N 2610/14
See application file for complete search history.

(56) References Cited

U.S. PATENT DOCUMENTS

| | | | | |
|---|---|---|---|---|
| 10,739,078 | B2 | 8/2020 | Markussen | |
| 2001/0018034 | A1* | 8/2001 | Wakasa | F28D 1/06 422/198 |
| 2005/0006490 | A1* | 1/2005 | Dancey | F23K 5/20 237/19 |
| 2007/0214599 | A1* | 9/2007 | Clements | C23C 16/4412 15/363 |
| 2008/0256937 | A1 | 10/2008 | Suzuki | |
| 2012/0031082 | A1 | 2/2012 | Gismervik | |
| 2014/0238459 | A1 | 8/2014 | Moors et al. | |
| 2017/0138826 | A1* | 5/2017 | Thomsen | F01N 3/2066 |
| 2017/0159523 | A1 | 6/2017 | Borsoi et al. | |
| 2019/0003630 | A1* | 1/2019 | Barthel | F16L 53/38 |
| 2019/0112956 | A1* | 4/2019 | Kadau | B01J 19/0013 |

FOREIGN PATENT DOCUMENTS

| | | | |
|---|---|---|---|
| CN | 101266117 B | | 10/2010 |
| DE | 102015220212 | * | 4/2017 |

* cited by examiner

*Primary Examiner* — Phutthiwat Wongwian
*Assistant Examiner* — Diem T Tran
(74) *Attorney, Agent, or Firm* — Carlson, Gaskey & Olds, P.C.

(57) ABSTRACT

A heater for a vehicle exhaust system includes a housing defining a fluid chamber, and the housing has a fluid inlet configured to receive fluid from a fluid supply and a fluid outlet. A helical body is positioned within the fluid chamber and a heater is integrated into the helical body to heat fluid supplied from the fluid supply such that heated fluid can be injected into a vehicle exhaust component via the fluid outlet. At least one sensor is integrated into the helical body to measure a fluid characteristic.

19 Claims, 3 Drawing Sheets

INTEGRATED HELICAL HEATER AND TEMPERATURE SENSOR

BACKGROUND

An exhaust system includes catalyst components to reduce emissions. The exhaust system includes an injection system that injects a diesel exhaust fluid (DEF), or a reducing agent such as a solution of urea and water for example, upstream of a selective catalytic reduction (SCR) catalyst which is used to reduce NOx emissions. The injection system includes a doser that sprays the fluid into the exhaust stream via an injection valve. In order to achieve optimal operating conditions, the DEF needs to be heated quickly and efficiently to a prescribed temperature.

SUMMARY

In one exemplary embodiment, a heater for a vehicle exhaust system includes, among other things, a housing defining a fluid chamber, wherein the housing has a fluid inlet configured to receive fluid from a fluid supply and a fluid outlet. A helical body is positioned within the fluid chamber and a heater is integrated into the helical body to heat fluid supplied from the fluid supply such that heated fluid can be injected into a vehicle exhaust component via the fluid outlet. At least one sensor is integrated into the helical body to measure a fluid characteristic.

In a further embodiment of the above, the at least one sensor comprises a temperature sensor integrated into the helical body.

In a further embodiment of any of the above, the temperature sensor includes a first portion that is embedded within the helical body and a second portion that extends outwardly of the helical body and is exposed to the fluid.

In a further embodiment of any of the above, the temperature sensor comprises a thermistor, resistive temperature detector, thermocouple, or other temperature sensing device.

In a further embodiment of any of the above, a controller controls the heater to heat the fluid to a predetermined temperature.

In a further embodiment of any of the above, the temperature sensor comprises a feedback loop to the controller.

In a further embodiment of any of the above, the helical body comprises a cylindrical center body defining a center axis and a spiraling body portion that spirals about the cylindrical center body along a length of the cylindrical center body from a first end of the cylindrical center body to a second end of the cylindrical center body.

In a further embodiment of any of the above, the fluid chamber is defined by an inner peripheral wall surface of the housing, and wherein an outermost surface of the spiraling body portion is in direct contact with the inner peripheral wall surface.

In a further embodiment of any of the above, the spiraling body portion provides for open areas between adjacent spirals such that the open areas are axially spaced apart from each other from the first end of the cylindrical center body to the second end.

In a further embodiment of any of the above, the fluid chamber includes a first end wall with at least one first orifice that comprises the fluid inlet and a second end wall with a second orifice that comprises the fluid outlet, and wherein the inner peripheral wall surface extends between the first and second end walls, and including at least one valve associated with the fluid inlet or fluid outlet.

In a further embodiment of any of the above, the at least one valve comprises a first valve associated with the fluid inlet and a second valve associated with the fluid outlet.

In a further embodiment of any of the above, the heater comprises a heating element that is embedded within the spiraling body portion and spirals about the cylindrical center body from the first end to the second end such that an electrical current that is passed through the heating element heats the helical body along an entirety of the length of the helical body.

In a further embodiment of any of the above, the helical body is comprised of ceramic, stainless steel, or high-temperature material.

In a further embodiment of any of the above, the fluid comprises DEF and wherein the vehicle exhaust component defines an exhaust gas flow path that receives exhaust gases from an engine, and wherein the DEF is heated within the fluid chamber to a desired temperature and is injected into the exhaust gas flow path.

In another exemplary embodiment, a vehicle exhaust system includes, among other things, an exhaust component defining an exhaust gas flow path that receives exhaust gases from an engine, a doser configured to receive DEF from a fluid supply and to inject DEF into the exhaust gas flow path, and a heater configured to heat the DEF prior to injection of the DEF into the exhaust gas flow path. The heater comprises a housing defining a fluid chamber, wherein the housing has a fluid inlet configured to receive DEF from the fluid supply and a fluid outlet. A helical body is positioned within the fluid chamber. A heating element is integrated into the helical body to heat DEF supplied from the fluid supply such that heated DEF can be injected into the exhaust component via the fluid outlet. At least one temperature sensor is integrated into the helical body to measure a temperature of the DEF, and a controller controls the heater based on feedback from the temperature sensor to heat the DEF to a predetermined temperature.

In a further embodiment of any of the above, the helical body comprises a cylindrical center body defining a center axis and a spiraling body portion that spirals about the cylindrical center body along a length of the cylindrical center body from a first end of the cylindrical center body to a second end of the cylindrical center body, the fluid chamber is defined by an inner peripheral wall surface of the housing, and an outermost surface of the spiraling body portion is in direct contact with the inner peripheral wall surface.

In a further embodiment of any of the above, the spiraling body portion provides for open areas between adjacent spirals such that the open areas are axially spaced apart from each other along the cylindrical center body from the first end of the cylindrical center body to the second end.

In a further embodiment of any of the above, the fluid chamber includes a first end wall with at least one first orifice that comprises the fluid inlet and a second end wall with a second orifice that comprises the fluid outlet, and wherein the inner peripheral wall surface extends between the first and second end walls, an including at least one valve associated with the fluid inlet or fluid outlet.

In a further embodiment of any of the above, the heating element is embedded within the spiraling body portion and spirals about the cylindrical center body from the first end to the second end such that an electrical current that is passed through the heating element heats the helical body along an entirety of the length of the helical body.

In a further embodiment of any of the above, the temperature sensor includes a first portion that is embedded within the helical body and a second portion that extends outwardly of the helical body and is exposed to the DEF.

These and other features of this application will be best understood from the following specification and drawings, the following of which is a brief description.

DETAILED DESCRIPTION

Figure 1:
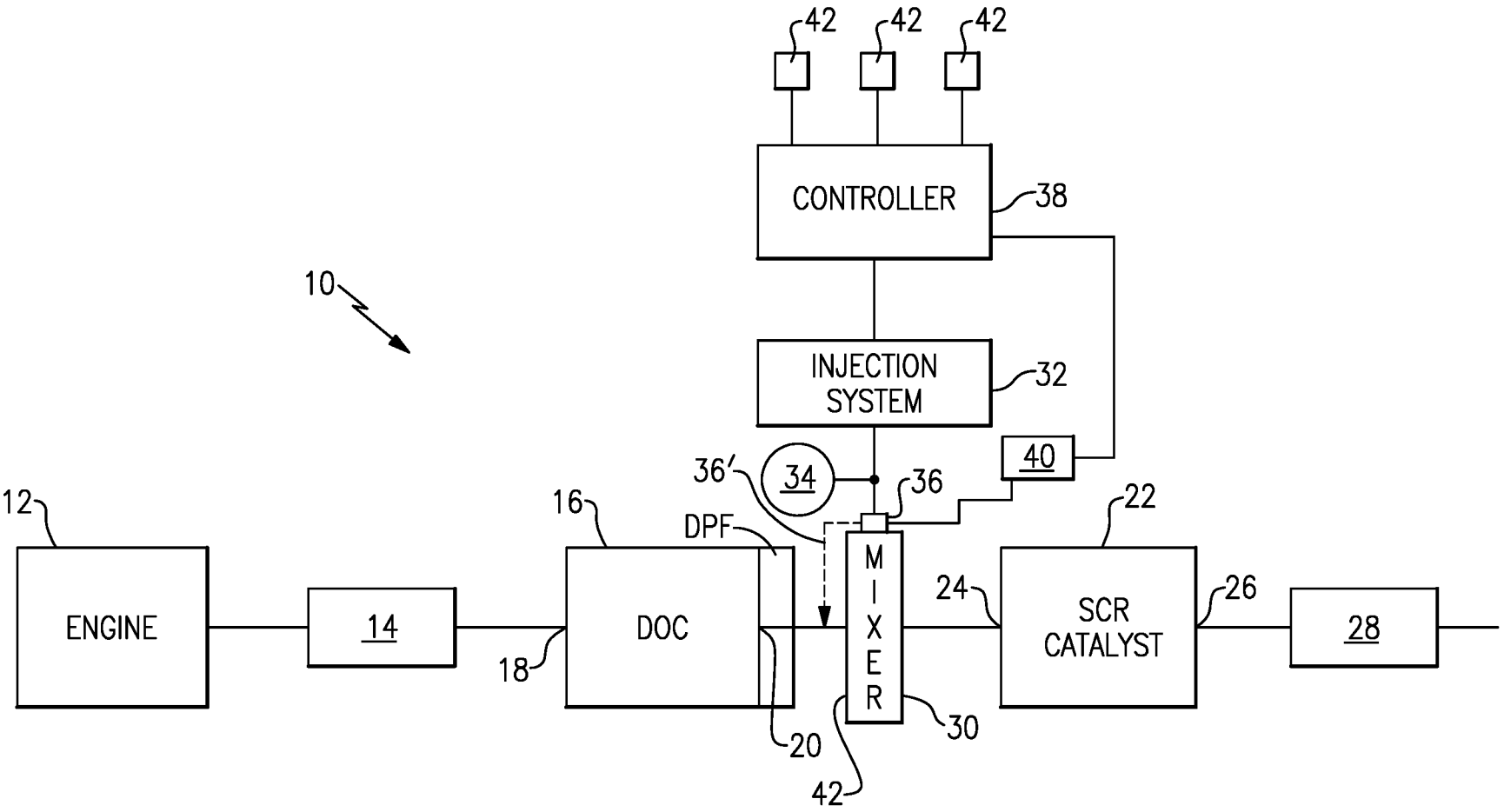
FIG. 1 schematically illustrates one example of an exhaust system with an injection system according to the subject disclosure.

FIG. 1 shows a vehicle exhaust system 10 that conducts hot exhaust gases generated by an engine 12 through various upstream exhaust components 14 to reduce emission and control noise as known. In one example configuration, the upstream exhaust component 14 comprises at least one pipe that directs engine exhaust gases into one or more exhaust gas aftertreatment components. In one example, the exhaust gas after-treatment components include a diesel oxidation catalyst (DOC) 16 having an inlet 18 and an outlet 20, and an optional diesel particulate filter (DPF) that is used to remove contaminants from the exhaust gas as known. Downstream of the DOC 16 and optional DPF is a selective catalytic reduction (SCR) catalyst 22 having an inlet 24 and an outlet 26. The outlet 26 communicates exhaust gases to downstream exhaust components 28. Optionally, component 22 can comprise a catalyst that is configured to perform a selective catalytic reduction function and a particulate filter function. The various downstream exhaust components 28 can include one or more of the following: pipes, filters, valves, catalysts, mufflers etc. These upstream 14 and downstream 28 components can be mounted in various different configurations and combinations dependent upon vehicle application and available packaging space.

In one example, a mixer 30 is positioned downstream from the outlet 20 of the DOC 16 or DPF and upstream of the inlet 24 of the SCR catalyst 22. The upstream catalyst and downstream catalyst can be in-line or in parallel, for example. The mixer 30 is used to facilitate mixing of the exhaust gas.

An injection system 32 is used to inject a reducing agent, such as diesel exhaust fluid (DEF), for example, into the exhaust gas stream upstream from the SCR catalyst 22 such that the mixer 30 can mix the DEF and exhaust gas thoroughly together. The injection system 32 includes a fluid supply tank 34, a doser 36, and a controller 38 that controls injection of the fluid as known. In one example, the doser 36 injects the DEF into the mixer 30 as shown in FIG. 1. In other examples, the doser 36 can inject the DEF into the exhaust system at other locations such as upstream of the mixer 30 as schematically indicated at 36'. Additionally, the SCR catalyst 22 could be downstream of component 14 and upstream of DOC 16 as an alternative, and the doser 36 and mixer 30 would be positioned to stay upstream of the SCR catalyst 22.

Providing ultra-low NOx emissions requires dosing at low temperatures to address de-nox at cold start and low load cycles. Dosing DEF at low temperatures raises thermolysis and deposit issues as there is usually insufficient heat from the exhaust gas to manage deposits. To address these issues, the injection system 32 heats the DEF prior to entering the mixer 30, or prior to entering the SCR catalyst 22 if there is no mixer, which provides for faster atomization and better mixing.

A heater 40 is used to pre-heat the DEF prior to mixing with exhaust gas. The heater 40 is shown in greater detail in FIG. 3. Preheating of the DEF occurs in the heater 40 before the DEF is injected into the exhaust system 10. The heated DEF can be in the form of a liquid, gas, or a mixture of both.

A control system includes the controller 38 that controls heating of the DEF and/or injection of the DEF based on one or more of exhaust gas temperature, backpressure, time, and wear. Additionally, there are a plurality of system sensors 42 that can be used to determine temperatures throughout the system, flow rates, rate of deposit formation, and wear, for example. The sensors 42 communicate data to the controller 38 such that the controller can determine when to generate a control signal, which is communicated to the injection system 32 to control when DEF is to be injected.

The controller 38 can be a dedicated electronic control unit or can be an electronic control unit associated with a vehicle system control unit or sub-system control unit. The controller 38 can include a processor, memory, and one or more input and/or output (I/O) device interface(s) that are communicatively coupled via a local interface. The controller 38 may be a hardware device for executing software, particularly software stored in memory. The controller 38 can be a custom made or commercially available processor, or generally any device for executing software instructions.

Figure 2:
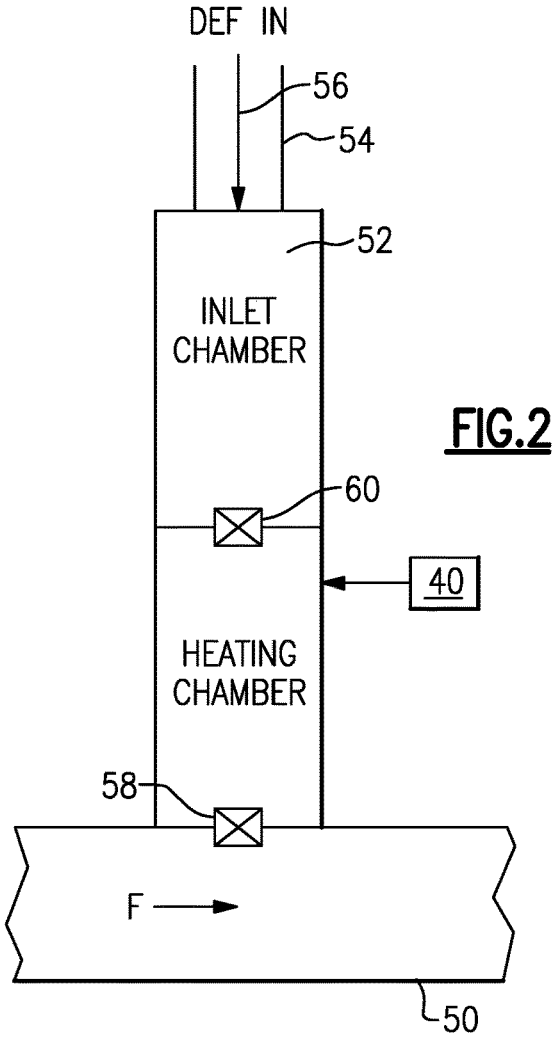
FIG. 2 is a schematic view of fluid flow within the injection system of FIG. 1.

FIG. 2 schematically shows an exhaust component 50, such as a pipe for example, which defines an exhaust gas flow path F that receives exhaust gases from the engine 12. The exhaust component 50 could also be a housing for an after-treatment element or a mixer, for example. As discussed above, the injection system 32 is configured to inject heated DEF into the exhaust gas flow path F. The injection system 32 includes an inlet chamber 52 that receives the DEF through a supply line 54 as indicated at 56. The inlet chamber 52 is in fluid communication with the heater 40 that receives the DEF from the inlet chamber 52 and heats the DEF to a desired temperature before the heated DEF is introduced into the exhaust component 50 via a valve 58. Another valve 60 is used to control fluid flow between the inlet chamber 52 and the heater 40. The controller 38 controls the valves and any suitable types of valves 58, 60 can be used to control the fluid flow.

Figure 3:
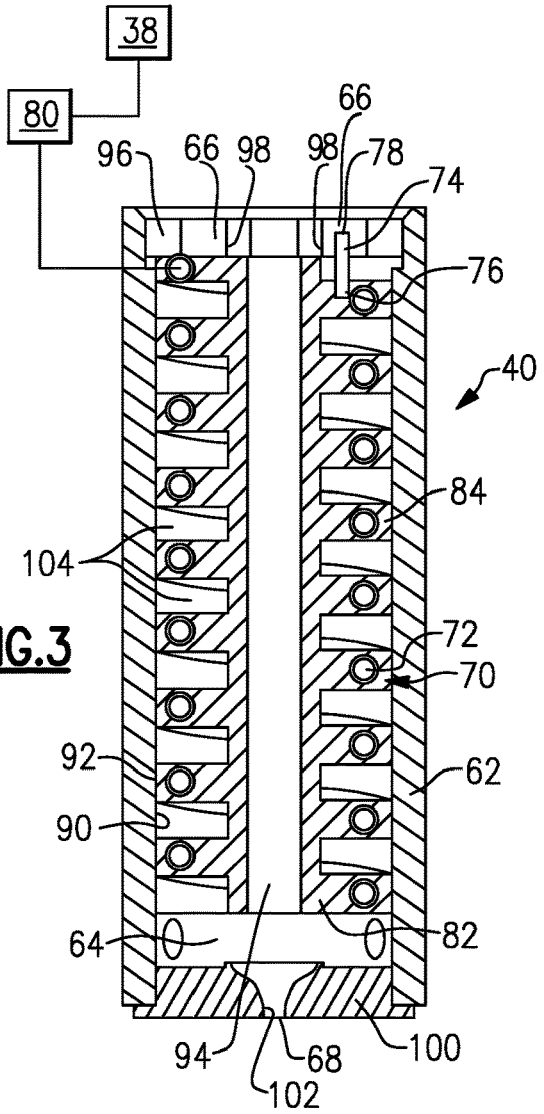
FIG. 3 is a cross-sectional side view of a heater as used in the injection system of FIG. 1.

As shown in FIG. 3, the heater 40 includes a housing 62 defining a fluid chamber 64 and having at least one fluid inlet 66 that receives fluid from the fluid supply 34 and a fluid outlet 68. A helical body 70 is positioned within the fluid chamber 64. A heater or heating element 72 is integrated into the helical body 70 to heat the DEF such that heated DEF can be injected into the vehicle exhaust component 50 via the fluid outlet 68. At least one sensor 74 is also integrated into the helical body 70 to measure a fluid characteristic.

In one example, the at least one sensor 74 comprises a temperature sensor 74. The temperature sensor 74 includes a first portion 76 that is embedded within the helical body 70 and a second portion 78 that extends outwardly of the helical body 70 and is directly exposed to the fluid. In one example, the temperature sensor comprises a thermistor, resistive temperature detector, thermocouple, or other suitable temperature measuring sensor.

The controller 38 controls the heating element 72 of the heater 40 to heat the fluid to a predetermined temperature. In this example, the temperature sensor 74 comprises a feedback loop to the controller 38, which provides the most accurate heater temperature. This also ensures that an appropriate temperature or temperature range can be selected/monitored.

The heating element 72 is integrated into the helical body 70. In one example, the heating element 72 comprises a wire that is embedded and completely enclosed within the helical body 70. The heating element 72 is connected to power source 80 that is controlled by the controller 38. When an electrical current is passed through the heating element 72, the material of the helical body 70 that surrounds the heating element 72 is quickly heated. In one example, the helical body 70 heats the DEF to a nominal temperature of 160° C. However, the temperature could be modulated if needed based on an amount of current delivered to the heating elements 72. Further, the DEF could be heated to be within a desired temperature range such as from 120° C. to 200° C. Determining the appropriate temperature range is based on factors such as droplet size, droplet velocity, and vapor/liquid ratio, etc.

In one example, the helical body 70 is comprised of a ceramic, stainless steel, or DEF corrosion resistant material; however other suitable materials could also be used. The housing 62 could also be made from any suitable metallic material.

Figure 4A:
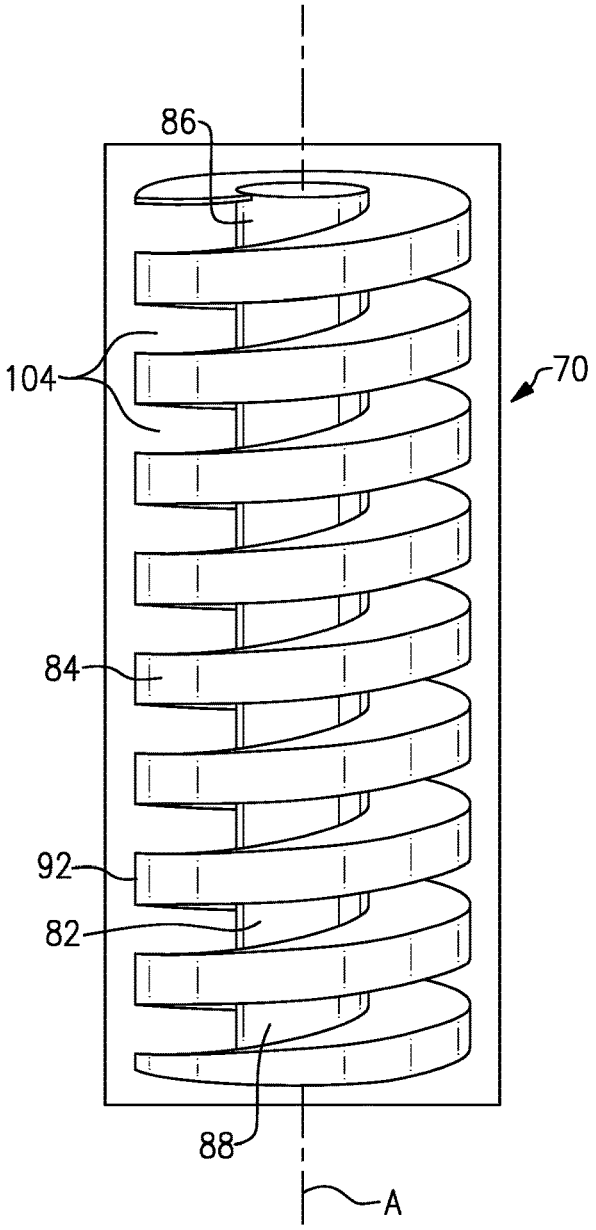
FIG. 4A is a perspective view of a helical body of the heater of FIG. 3.
Figure 4B:
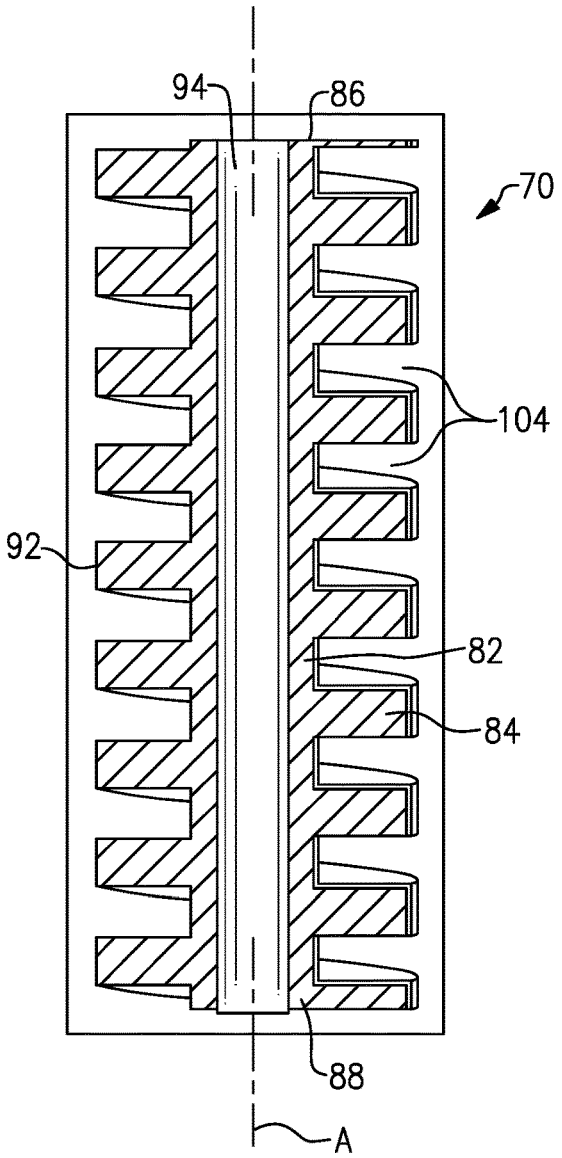
FIG. 4B is a section view of the helical body of FIG. 4A.

In one example shown in FIGS. 4A-B, the helical body 70 comprises a cylindrical center body 82 defining a center axis A and a spiraling body portion 84 that spirals about the cylindrical center body 82. The spiraling body portion 84 extends along a length of the cylindrical center body 82 from a first end 86 of the cylindrical center body 82 to a second end 88 of the cylindrical center body 82. The fluid chamber 64 is defined by an inner peripheral wall surface 90 of the housing 62. In one example, an outermost surface 92 of the spiraling body portion 84 is in direct contact with the inner peripheral wall surface 90. This direct contact optimizes the heat transfer to the DEF.

In one example, the cylindrical center body 82 includes a central passage 94 that extends from the first end 86 of the cylindrical center body 82 to the second end 88, and which receives a shaft (not shown). The fluid chamber 64 includes a first end wall 96 with at least one first orifice 98 that comprises the fluid inlet 66 and a second end wall 100 with a second orifice 102 that comprises the fluid outlet 68. The inner peripheral wall surface 90 extends between the first 96 and second 98 end walls. In one example, there are two first orifices 98, one on each side of the central passage 94, such that there are two fluid inlets 66.

In one example, the heating element 72 is embedded within the spiraling body portion 84 and spirals about the cylindrical center body 82 from the first end 86 to the second end 88 such that when an electrical current is passed through the heating element 72, the helical body 70 is heated along an entirety of the length of the helical body 70. The fluid flows into the fluid inlet 66 to fill the fluid chamber 64. The spiraling body portion 84 provides for open areas 104 between adjacent spirals resulting in a significant amount of surface area that can be quickly heated by the heating elements 72. The heated DEF then exits the fluid chamber 64 via the fluid outlet 68.

In one example, the first valve 58 is associated with the fluid outlet 68 and the second valve 60 associated with the fluid inlet 66. The controller 38 controls flow through the valves 58, 60 to achieve the desired temperature levels and to control the time and length of injection of fluid into the exhaust component 50.

The subject disclosure provides a heater element that is integrated inside a helical element to provide a very efficient heat transfer rate to the DEF. The subject disclosure also utilizes a temperature sensor that is integrated into the helical element. This configuration quickly heats the DEF in the fluid chamber to a desired temperature within a few seconds by utilizing temperature feedback for efficient control of power to the heating elements. The use of the helical shaped element significantly improves heat transfer between the components and the DEF. In addition, the number of components is reduced and the amount packaging space required for the components is reduced.

Although an embodiment of this disclosure has been disclosed, a worker of ordinary skill in this art would recognize that certain modifications would come within the scope of this disclosure. For that reason, the following claims should be studied to determine the true scope and content of this disclosure.

The invention claimed is:

1. A heater for a vehicle exhaust system comprising:

a housing defining a fluid chamber, the housing having a fluid inlet configured to receive fluid from a fluid supply and a fluid outlet;

a helical body positioned within the fluid chamber;

a heater integrated into the helical body to heat fluid supplied from the fluid supply such that heated fluid can be injected into a vehicle exhaust component via the fluid outlet; and at least one sensor integrated into the helical body by being at least partially embedded within the helical body, the at least one sensor configured to measure a fluid characteristic, and wherein the at least one sensor comprises a temperature sensor integrated into the helical body, and, wherein the temperature sensor includes a first portion that is embedded within the helical body and a second portion that extends outwardly of the helical body and is exposed to the fluid.

2. The heater according to claim 1, wherein the temperature sensor comprises a thermistor, resistive temperature detector, thermocouple, or other temperature sensing device.

3. The heater according to claim 1, including a controller that controls the heater to heat the fluid to a predetermined temperature.

4. The heater according to claim 3, wherein the temperature sensor comprises a feedback loop to the controller.

5. The heater according to claim 1, wherein the helical body comprises a cylindrical center body defining a center axis and a spiraling body portion that spirals about the cylindrical center body along a length of the cylindrical center body from a first end of the cylindrical center body to a second end of the cylindrical center body.

6. The heater according to claim 5, wherein the fluid chamber is defined by an inner peripheral wall surface of the housing, and wherein an outermost surface of the spiraling body portion is in direct contact with the inner peripheral wall surface.

7. The heater according to claim 6, wherein the spiraling body portion provides for open areas between adjacent spirals such that the open areas are axially spaced apart from each other from the first end of the cylindrical center body to the second end.

8. The heater according to claim 7, wherein the fluid chamber includes a first end wall with at least one first orifice that comprises the fluid inlet and a second end wall with a second orifice that comprises the fluid outlet, and wherein the inner peripheral wall surface extends between the first and second end walls, and including at least one valve associated with the fluid inlet or fluid outlet.

9. The heater according to claim 1, wherein the fluid comprises DEF and wherein the vehicle exhaust component defines an exhaust gas flow path that receives exhaust gases from an engine, and wherein the DEF is heated within the fluid chamber to a desired temperature and is injected into the exhaust gas flow path.

10. The heater according to claim 1, wherein the heater comprises a wire that is embedded and completely enclosed within the helical body.

11. A heater for a vehicle exhaust system comprising:

a housing defining a fluid chamber, the housing having a fluid inlet configured to receive fluid from a fluid supply and a fluid outlet, and wherein the fluid chamber is defined by an inner peripheral wall surface of the housing, and wherein the fluid chamber includes a first end wall with at least one first orifice that comprises the fluid inlet and a second end wall with a second orifice that comprises the fluid outlet, and wherein the inner peripheral wall surface extends between the first and second end walls;

a helical body positioned within the fluid chamber, wherein the helical body comprises a cylindrical center body defining a center axis and a spiraling body portion that spirals about the cylindrical center body along a length of the cylindrical center body from a first end of the cylindrical center body to a second end of the cylindrical center body, and wherein an outermost surface of the spiraling body portion is in direct contact with the inner peripheral wall surface, and wherein the spiraling body portion provides for open areas between adjacent spirals such that the open areas are axially spaced apart from each other from the first end of the cylindrical center body to the second end;

a heater integrated into the helical body to heat fluid supplied from the fluid supply such that heated fluid can be injected into a vehicle exhaust component via the fluid outlet;

at least one sensor integrated into the helical body by being at least partially embedded within the helical body, the at least one sensor configured to measure a fluid characteristic;

a first valve associated with the fluid inlet; and a second valve associated with the fluid outlet.

12. A vehicle exhaust system comprising:

an exhaust component defining an exhaust gas flow path that receives exhaust gases from an engine;

a doser configured to receive DEF from a fluid supply and to inject DEF into the exhaust gas flow path;

a heater configured to heat the DEF prior to injection of the DEF into the exhaust gas flow path, the heater comprising a housing defining a fluid chamber, the housing having a fluid inlet configured to receive DEF from the fluid supply and a fluid outlet, a helical body positioned within the fluid chamber, a heating element integrated into the helical body to heat DEF supplied from the fluid supply such that heated DEF can be injected into the exhaust component via the fluid outlet, and at least one temperature sensor integrated into the helical body by being at least partially embedded within the helical body, the at least one temperature sensor configured to measure a temperature of the DEF, an inlet chamber configured to receive the DEF through a supply line, at least one first valve that is used to control fluid flow between the inlet chamber and the fluid chamber of the heater, and at least one second valve that is used to control flow of the heated DEF from the fluid chamber to the exhaust component, and a controller to control the heater based on feedback from the temperature sensor to heat the DEF to a predetermined temperature.

13. The vehicle exhaust system according to claim 12, wherein the helical body comprises a cylindrical center body defining a center axis and a spiraling body portion that spirals about the cylindrical center body along a length of the cylindrical center body from a first end of the cylindrical center body to a second end of the cylindrical center body, the fluid chamber is defined by an inner peripheral wall surface of the housing, and an outermost surface of the spiraling body portion in direct contact with the inner peripheral wall surface.

14. The vehicle exhaust system according to claim 13, wherein the spiraling body portion provides for open areas between adjacent spirals such that the open areas are axially spaced apart from each other along the cylindrical center body from the first end of the cylindrical center body to the second end.

15. The vehicle exhaust system according to claim 14, wherein the fluid chamber includes a first end wall with at least one first orifice that comprises the fluid inlet and a second end wall with a second orifice that comprises the fluid outlet, and wherein the inner peripheral wall surface extends between the first and second end walls, an including at least one valve associated with the fluid inlet or fluid outlet.

16. The vehicle exhaust system according to claim 14, wherein the heating element is embedded within the spiraling body portion and spirals about the cylindrical center body from the first end to the second end such that an electrical current that is passed through the heating element heats the helical body along an entirety of the length of the helical body.

17. A vehicle exhaust system comprising:

an exhaust component defining an exhaust gas flow path that receives exhaust gases from an engine;

a doser configured to receive DEF from a fluid supply and to inject DEF into the exhaust gas flow path;

a heater configured to heat the DEF prior to injection of the DEF into the exhaust gas flow path, the heater comprising a housing defining a fluid chamber, the housing having a fluid inlet configured to receive DEF from the fluid supply and a fluid outlet, wherein the fluid chamber is defined by an inner peripheral wall surface of the housing, a helical body positioned within the fluid chamber, the helical body comprising a cylindrical center body defining a center axis and a spiraling body portion that spirals about the cylindrical center body along a length of the cylindrical center body from a first end of the cylindrical center body to a second end of the cylindrical center body, and wherein an outermost surface of the spiraling body portion is in direct contact with the inner peripheral wall surface, and wherein the spiraling body portion provides for open areas between adjacent spirals such that the open areas are axially spaced apart from each other along the cylindrical center body from the first end of the cylindrical center body to the second end, a heating element integrated into the helical body to heat DEF supplied from the fluid supply such that heated DEF can be injected into the exhaust component via the fluid outlet, and wherein the heating element is embedded within the spiraling body portion and spirals about the cylindrical center body from the first end to the second end such that an electrical current that is passed through the heating element heats the helical body along an entirety of the length of the helical body, and at least one temperature sensor integrated into the helical body by being at least partially embedded within the helical body, the at least one temperature sensor configured to measure a temperature of the DEF, and a controller to control the heater based on feedback from the temperature sensor to heat the DEF to a predetermined temperature, wherein the temperature sensor includes a first portion that is embedded within the helical body and a second portion that extends outwardly of the helical body and is exposed to the DEF.

18. A vehicle exhaust system comprising:

an exhaust component defining an exhaust gas flow path that receives exhaust gases from an engine;

a doser configured to receive DEF from a fluid supply and to inject DEF into the exhaust gas flow path;

a heater configured to heat the DEF prior to injection of the DEF into the exhaust gas flow path, the heater comprising a housing defining a fluid chamber, the housing having a fluid inlet configured to receive DEF from the fluid supply and a fluid outlet, a helical body positioned within the fluid chamber, a heating element integrated into the helical body to heat DEF supplied from the fluid supply such that heated DEF can be injected into the exhaust component via the fluid outlet, wherein the heating element comprises a wire that is embedded and completely enclosed within the helical body, at least one temperature sensor integrated into the helical body by being at least partially embedded within the helical body, the at least one temperature sensor configured to measure a temperature of the DEF, and wherein the at least one temperature sensor includes a first portion that is embedded within the helical body and a second portion that extends outwardly of the helical body and is exposed to the DEF, and a controller to control the heater based on feedback from the temperature sensor to heat the DEF to a predetermined temperature.

19. A heater for a vehicle exhaust system comprising:

a housing defining a fluid chamber, the housing having a fluid inlet configured to receive fluid from a fluid supply and a fluid outlet;

a helical body positioned within the fluid chamber;

a heater integrated into the helical body to heat fluid supplied from the fluid supply such that heated fluid can be injected into a vehicle exhaust component via the fluid outlet;

at least one sensor integrated into the helical body by being at least partially embedded within the helical body, the at least one sensor configured to measure a fluid characteristic;

an inlet chamber configured to receive the fluid through a supply line;

at least one first valve that is used to control fluid flow between the inlet chamber and the fluid chamber; and at least one second valve that is used to control flow of the heated fluid from the fluid chamber to the vehicle exhaust component.

* * * * *